US006534908B1

(12) United States Patent
Nose et al.

(10) Patent No.: US 6,534,908 B1
(45) Date of Patent: Mar. 18, 2003

(54) CATHODE RAY TUBE

(75) Inventors: Hisashi Nose, Kawasaki (JP); Hiroshi Ito, Mobara (JP); Kenji Kawamata, Sakura (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/512,474

(22) Filed: Feb. 24, 2000

(30) Foreign Application Priority Data

Feb. 24, 1999 (JP) ..... 11-046408

(51) Int. Cl.[7] ..... H01J 29/56
(52) U.S. Cl. ..... 313/477 R; 362/482; 362/440
(58) Field of Search ..... 313/477 R, 482, 313/440

(56) References Cited

U.S. PATENT DOCUMENTS 5,489,824 A * 2/1996 Grote et al. ..... 313/371
5,929,559 A * 7/1999 Sano et al. ..... 313/447 R
6,268,692 B1 * 7/2001 Yokota et al. ..... 313/477 R

FOREIGN PATENT DOCUMENTS

JP 44-29152 U 12/1969
JP 10-144238 5/1998

* cited by examiner

*Primary Examiner*—Sandra O'Shea
*Assistant Examiner*—Anabel Ton
(74) *Attorney, Agent, or Firm*—Antonelli, Terry, Stout & Kraus, LLP

(57) ABSTRACT

A color cathode ray tube includes a vacuum envelope comprised of a neck portion having a circular cross section and a funnel portion having a deflection yoke mounting region of pyramidal shape at a side which is connected to said neck portion. In this color cathode ray tube, an inflection edge in which an inner surface angle changes from an inner wall of the deflection yoke mounting region to a panel portion side inner wall of said funnel portion is formed on an inner surface of a funnel portion at a panel portion side terminal end of the deflection yoke mounting region, and an angle made by a straight line which passes through an endmost face of the inflection edge and is perpendicular to the tube axis and a tangent line at the endmost face is within 5°–11°. The pyramidal deflection yoke mounting region has the inner wall opening perpendicular to the tube axis direction formed in a pin cushion shape and recesses having a curvature are formed at respective corners. The distance between a first straight line which connects bottom portions of neighboring recesses of the corner portions and a second straight line which is in contact with a central point of an inner wall between the neighboring corners and is parallel with the first straight line is not more than 2.0 mm or preferably not more than 0.1 mm, provided that said tube axis direction is taken as +.

20 Claims, 8 Drawing Sheets

(a – a')

(b – b')

(c – c')

CATHODE RAY TUBE

FIELD OF THE INVENTION

The present invention relates to a cathode ray tube, and, more particularly, to a shortened cathode ray tube having an envelope which has a sufficient mechanical strength in a narrowed deflection yoke mounting area.

BACKGROUND OF THE INVENTION

In general, a cathode ray tube which is employed as an image display device is constituted by a vacuum envelope which is formed by connecting a panel portion which forms a screen having a phosphor coating on an inner surface thereof, a neck portion which accommodates an electron gun, and a funnel portion having a funnel shape which gradually decreases in diameter in the direction from the panel portion to the neck portion.

In a color cathode ray tube, a color screen formed of a plurality (usually three colors) of phosphors is provided on the inner surface of the panel portion, a shadow mask which operates as a color selection electrode is arranged adjacent to the screen, and an inline-type electron gun which irradiates three electron beams is accommodated in the neck portion.

The color cathode ray tube includes a stem at the end of the neck portion, which stem supports the accommodated electron gun and is provided with stem pins which supply a given voltage or given signals to the electron gun and are mounted in an annular manner, thus sealing the neck portion. A deflection yoke which scans the electron beams on the screen by deflecting the electron beams in both horizontal and vertical directions is mounted on the outer surface of the funnel portion.

A color display tube (CDT) used as a monitor device of an information processing terminal is used with a higher deflection frequency than a conventional cathode ray tube for television, and hence, the deflection power is increased.

In such a cathode ray tube, as a means for reducing the power consumed by the deflection yoke, the outer diameter size of a portion on which the deflection yoke of the funnel is mounted (deflection yoke mounting region) may be reduced in size so as to bring the deflection yoke closer to the electron beams, thus more efficiently applying the deflection magnetic field to the electron beams.

However, in case the outer diameter of the deflection yoke mounting region is simply reduced in size, a portion of the funnel portion connected to the neck portion (smaller diameter portion of the funnel portion) becomes narrow, and hence, at the time that the electron beams are deflected through the maximum deflection angle, the electron beams impinge on the inner surface of the funnel portion, thus giving rise to a region on the phosphor screen where the electron beams do not reach (non-scanned portion).

In view of this problem, Japanese Laid-Open Patent Publication 10-144238 discloses a cathode ray tube in which the outer wall in the deflection yoke mounting region of the funnel portion has a pyramidal shape so as to narrow the distance between the deflection yoke and the electron beams, while also avoiding the occurrence of a non-scanned portion.

Furthermore, in the cathode ray tube having a shortened length in the tube axis direction so as to provide an increased deflection angle, the enlargement angle from the neck portion to the funnel portion is increased. In such a cathode ray tube, a so-called inflection edge is formed, which inverts the curving direction of the inner wall surface toward the panel portion side of the deflection yoke mounting region.

FIG. 10 is a cross-sectional view showing a condition of a panel portion and a funnel portion of a conventional cathode ray tube cut along the short axis of the tube. Numeral 1 indicates the panel portion, numeral 2 indicates a neck portion, numeral 3 indicates the funnel portion, numeral 3A indicates a portion of a deflection yoke mounting region, and numeral **3*i* indicates an inner wall of the funnel portion 3. FIG. 10**(*a*) shows an enlarged view of the boundary between the deflection yoke mounting region of the funnel portion 3 and a panel-portion side inner wall, that is, a portion W of the wall including the inflection edge P where the inner surface angle changes from the inner wall of the deflection yoke mounting region to the panel-portion side inner wall of the funnel portion.

In the conventional cathode ray tube, as shown in FIG. 10, where the tube axis is represented by the line Z-Z, a straight line in the short axis direction which passes through the inflection edge P and is perpendicular to the tube axis Z-Z is represented as y-y, and a tangent line which passes through a point which intersects the straight line y-y of the inflection edge P is represented as a, an angle θ made by the straight line y-y and the tangent line a is set to a value not less than 11°.

Particularly, in a cathode ray tube having a contour in the deflection yoke mounting region in the form of a pyramidal shape, the vacuum envelope decreases its strength at a connection portion between the funnel portion and the neck portion, and hence, the possibility that a so-called implosion may occur is increased. In the above-mentioned Japanese Laid-Open Patent Publication 10-144238, to prevent the occurrence of an implosion, a reinforcing member is mounted on the connecting region between the pyramidal-shaped deflection yoke mounting region and the panel portion. In the cathode ray tube disclosed in Japanese Laid-Open Patent Publication 10-144238, the cross section of an outer wall thereof perpendicular to the tube axis of the deflection yoke mounting region is formed to have a rectangular shape and the cross section of an inner wall thereof is also formed to have a similar rectangular shape.

Further, in a cathode ray tube disclosed in Japanese Utility Model 44-29152, in case the deflection angle of the electron beams is large, to eliminate the above-mentioned non-scanned portion caused by the opening shape of a connecting portion between the funnel portion and the neck portion (narrow-diameter portion of the funnel portion) and to obviate implosion, the opening shape of the inner wall (cross section of the inner wall perpendicular to the tube axis) of the portion where the diameter of the funnel portion is narrowed is formed such that bulges which protrude inwardly are formed (in a so-called pin-cushion shape) on given portions of all of or two parallel sides out of four sides which form the profile line, and the corners are rounded.

In the conventional cathode ray tube, the angle θ made by the short axis, the long axis or the diagonal axis (of the rectangular cross-section) which are perpendicular to the tube axis, or the above-mentioned straight line y-y of the inner surface of the funnel portion on the respective axes and the tangent line a of the inner surface of the funnel portion, typically exceeds 11°. Therefore, in a cathode ray tube in which the deflection yoke mounting region is formed to have a pyramidal shape, the shape of the inner wall surface of the funnel portion from the large diameter portion of the panel portion side to the front end of the neck portion (small diameter portion of the funnel portion) via the deflection yoke mounting region cannot have a gentle profile. Particularly, an inflection edge where the inner wall surface changes its angle is formed at the side end portion of the panel portion of the deflection yoke mounting region of the funnel portion.

In the case of a cathode ray tube whose deflection yoke mounting region adopts a pyramidal funnel shape, it is necessary to make the angle (θ) of the tangent line at the inflection edge small to assure the mechanical strength of the funnel portion. In case the above-mentioned angle is made smaller, in an internal graphite film coating process, which constitutes one of the cathode ray tube's manufacturing steps, a coating liquid of graphite in the form of a film is settled on the inflection edge or it becomes difficult to smoothly coat the inner surface of the deflection yoke mounting region and the neck portion, and hence, the thickness of the internal graphite film becomes non-uniform due to the unevenness of the coating and the formation of a liquid well, so that a manual correction operation becomes necessary. Here, the internal graphite film has a function of supplying to the anode electrode of the electron gun a high voltage from an anode button which passes through the wall surface of the large diameter portion of the funnel from the front surface to the back surface thereof.

This internal graphite film is formed by a coating liquid in which graphite particles are dispersed in a solvent over the inner surface of the funnel portion and drying the coated liquid before connecting the panel portion to the funnel portion. That is, the funnel is rotated in a condition in which the funnel is vertically disposed with the large diameter side to which the panel portion is to be connected directed upwardly and the neck portion directed downwardly, and the internal graphite film is coated on the inner surface by means of an automatic brush coating machine.

Further, in the cathode ray tube which has a reduced length in the tube axis direction resulting in an increased deflection angle, the inner wall surface of the funnel portion on the diagonal line of the panel portion is remote from the tube axis, and hence, it is difficult to coat the graphite solution on this internal portion or the graphite before drying is concentrated on the corner portions so that the film thickness becomes uneven, thus giving rise to peeling off of the graphite film, or the graphite before drying sags in the inside of the neck portion, and hence, it becomes difficult to coat the internal graphite to a desired thickness. No consideration has been given for solving these problems with respect to conventional cathode ray tubes.

SUMMARY OF THE INVENTION

A color cathode ray tube of the present invention includes a vacuum envelope comprised of a panel portion having an approximately rectangular shape on which a phosphor film is formed on an inner surface thereof, a neck portion having a circular cross section which accommodates an electron gun, and a funnel portion having an opening cross section which is gradually enlarged toward a panel portion side thereof and is gradually reduced toward a neck portion side and includes a deflection yoke mounting region having a pyramidal shape at a side which is connected to the neck portion. An inflection edge at which the inner surface angle changes from an inner wall of the deflection yoke mounting region to a panel portion side inner wall of the funnel portion is formed on an inner surface of the funnel portion at the panel portion side terminal end of the deflection yoke mounting region, and an angle made by a straight line which passes through the endmost face of the inflection edge and is perpendicular to the tube axis and a tangent line at the endmost face is within 5°–11°.

In the pyramidal deflection yoke mounting region of the color cathode ray tube of the present invention, the inner wall opening thereof which is perpendicular to the tube axis direction is formed in a pin-cushion shape. Recesses having a curvature are formed in respective corners. The distance between a first straight line which connects bottom portions of neighboring recesses of the corner portions and a second straight line which is in contact with a central point of an inner wall between the neighboring corners and is parallel with the first straight line is not more than 2.0 mm and preferably not more than 1.0 mm, provided that the direction toward the tube axis is taken as +, and the relationship between a radius of curvature $R_1$ of the cross section of an outer wall at a reference line of a deflection yoke mounting region and a radius of curvature $R_2$ of the cross section of the inner wall is set such that $R_1 \geqq 100$ mm and $R_2 \geqq R_1$. Further, in the color cathode ray tube of the present invention, the outer diameter size of the neck is set to not less than 22.5 mm and less than 29.1 mm, and the distance between the center beam and the side beam of the electron gun is set to not more than 5.0 mm, and the deflection angle of the electron beam is not less than 90°.

Further, in the color cathode ray tube of the present invention, an angle made by a straight line which passes through an endmost face of the inflection edge and is perpendicular to the tube axis and a tangent line at the endmost face is 5°–11°. The color cathode ray tube includes a pyramidal deflection yoke mounting region, and at a position of the reference line set in the deflection yoke mounting region, the cross section of the outer wall which is perpendicular to the tube axis has an approximately rectangular shape, and the opening of the inner wall which is perpendicular to the tube axis has an approximately barrel shape. The radius of curvature of the cross section of the outer wall is set as $R_1$ (mm) and the radius of curvature of the cross section of the inner wall is set as $R_2$ (mm), with $R_1 \geqq 100$ mm and $R_2 \geqq R_1$, and the outer diameter size of the neck is set to not less than 22.5 mm and less than 29.1 mm. The distance between the center beam and the side beam of the electron gun is set to not more than 5.0 mm, and the deflection angle of the electron beam is not less than 90°.

Due to the respective constitutions set forth above, the present invention can provide a color cathode ray tube which can assure a sufficient mechanical strength in the vacuum envelope, which is provided with a pyramidal deflection yoke mounting region at the funnel portion, and simultaneously can facilitate a reliable internal graphite film coating operation, can reduce the power consumption, and can accommodate a shortened tube axial length. According to the present invention, the coating of the internal graphite film formed on the inner wall of the funnel portion is facilitated, and hence, an internal graphite film having a uniform thickness and which is free from peeling-off can be formed, thus providing a highly reliable cathode ray tube.

With a view toward enhancing the mechanical strength of the cathode ray tube, it is advantageous to make the angle θ at the inner surface of the funnel portion small. This is because, with a smaller angle θ, the inflection edge formed between the funnel portion and the transition portion of the deflection yoke mounting region of the funnel portion forms a step or a level difference, and hence, the vibration of an impact caused at the panel portion of the cathode ray tube will hardly be transmitted to the neck portion through the funnel portion, or the cross-sectional area at the step can be made as small as possible.

According to the present invention, by setting the angle θ to not more than 11°, which is smaller than that of the conventional cathode ray tube, the mechanical strength can be enhanced. To demonstrate is, the inventors have prepared cathode ray tubes which are set to various angles θ as samples and have found that in case the angle θ is set to not more than 11°, the required mechanical strength could be obtained.

On the other hand, the inventors have found that in case the angle θ is set to less than 5°, in the internal graphite film coating operation, when the tube axis of the cathode ray tube is held in a vertical direction, the funnel portion assumes substantially a horizontal condition, and hence, a coating liquid well is liable to occur. In case a graphite coating liquid well is present in the panel, the thickness of the internal graphite film becomes uneven, and hence, the emission characteristics of the cathode ray tube are deteriorated, or the film is peeled off and peeled-off pieces become foreign matter in the tube, which gives rise to poor withstand voltage characteristics.

The present invention is not limited to the above-mentioned constitutions an the constitutions of embodiments which will be explained hereinafter, and so various modifications can be considered without departing from the technical spirit of the present invention.

BRIEF DESCRIPTION OF THE DRAWINGS

FIG. 1(*b*) is a cross-sectional schematic view of an opening shape of an inflection edge P as seen in a region from line Q—Q to line R-R in FIG. 1(*a*).

FIG. 2(*b*) is a cross-sectional view illustrating the inflection edge in a panel short axis direction of the funnel portion of the color cathode ray tube of the embodiment.

FIG. 5(*b*) is a cross-sectional view of FIG. 4 taken along a line b–b'.

FIG. 5(*c*) is a cross-sectional view of FIG. 4 taken along a line b–b'.

FIG. 9(*b*) is a diagram of a cross-sectional shape of an inner wall at the deflection yoke mounting region shown in FIG. 8.

FIG. 10(*a*) is an enlarged detail view of a portion of the tube wall at the area of the funnel portion.

DESCRIPTION OF PREFERRED EMBODIMENT

Figure 1:
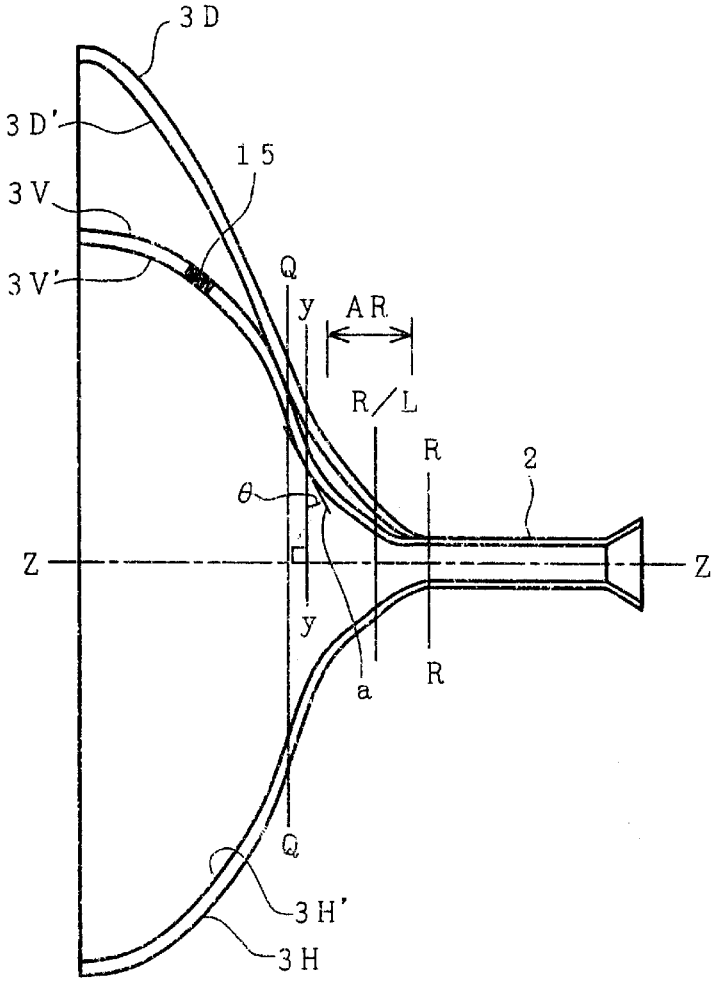
FIG. 1(*a*) is a cross-sectional schematic view taken along a tube axis direction to illustrate the angle of an inflection edge of a deflection yoke mounting region relative to a short axis, a long axis and a diagonal axis of a funnel portion of a color cathode ray tube in an embodiment before a panel portion is sealed.
Figure 1:
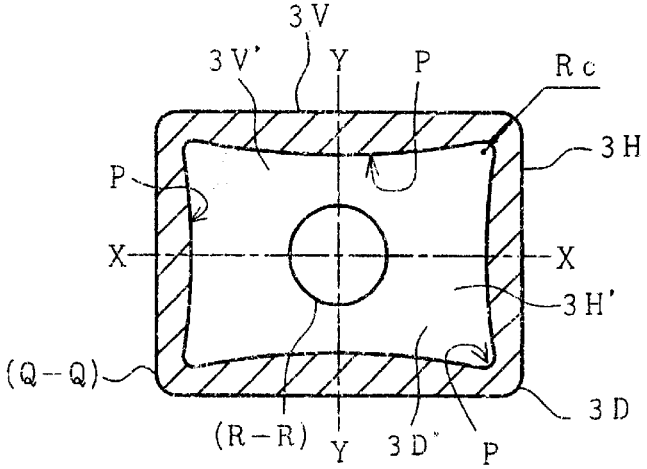

Embodiments of the present invention will be explained in conjunction with the attached drawings. FIG. 1(*a*) and FIG. 1(*b*) are schematic views illustrating a color cathode ray tube of this embodiment, and more particularly, showing an angle θ of an inflection edge in a deflection yoke mounting region of a funnel portion in a short axis direction, a long axis direction and a diagonal axis direction before the panel portion is sealed thereto. FIG. 1(*a*) is a cross-sectional view taken along the tube axis Z-Z and FIG. 1 (*b*) is a cross-sectional view showing the opening shape of the inflection edge P as seen in the region from the Q—Q line to the R—R line in FIG. 1(*a*).

In FIG. 1(*a*), numeral 2 indicates a neck portion, numeral 3V' indicates a funnel outer wall in a panel short axis direction, numeral 3V' indicates a funnel inner wall in a panel short axis direction, numeral 3H indicates a funnel outer wall in a panel long axis direction, numeral 3H' indicates a funnel inner wall in a panel long axis direction, numeral 3D indicates a funnel outer wall in a panel diagonal axis direction, numeral 3D' indicates a funnel inner wall in a panel diagonal axis direction, and numeral 15 indicates an anode button. Further, Z—Z indicates the tube axis, AR indicates a deflection yoke mounting region, R/L indicates a reference line, a indicates a tangent line of an inflection edge of an inner surface of a funnel portion, y-y indicates a straight line which passes through the inflection edge and is perpendicular to the tube axis Z-Z, and θ indicates an angle made by the tangent line a and the straight line y-y at the inflection edge. The above-mentioned reference line (R/L) is positioned at the central portion of the deflection yoke mounting region in the tube axis direction and such a region position is defined by EIAJ ED-2134. In FIG. 1(*a*), only the angle θ made by the tangent line a and the straight line y-y at a portion of the inflection edge P along the short axis is shown and the angles θ in other directions are omitted.

In this embodiment, at the inflection edge P of the inner surface (inner wall) of the funnel portion in the deflection yoke mounting region AR formed in the funnel portion of the cathode ray tube, the angle θ made between the tangent line a and the straight line y-y is set within a range of 5°–11°. The shape of the neck portion of the funnel portion is not limited to the shape shown in FIG. 1(*a*) and may adopt other shapes.

Figure 2:
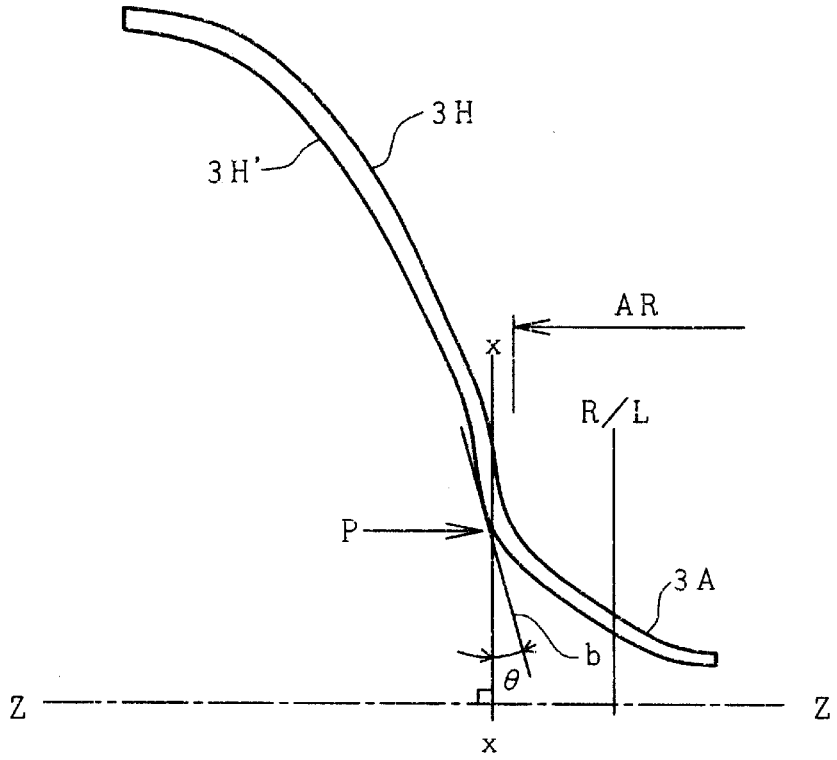
FIG. 2(*a*) is a cross-sectional view illustrating the inflection edge in a panel long axis direction of the funnel portion of the color cathode ray tube of the embodiment.
Figure 2:
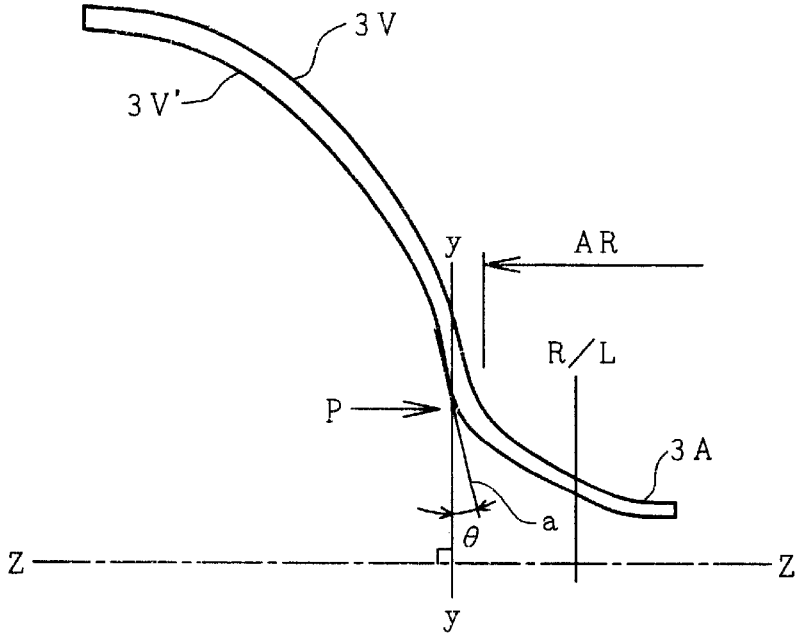
Figure 3:
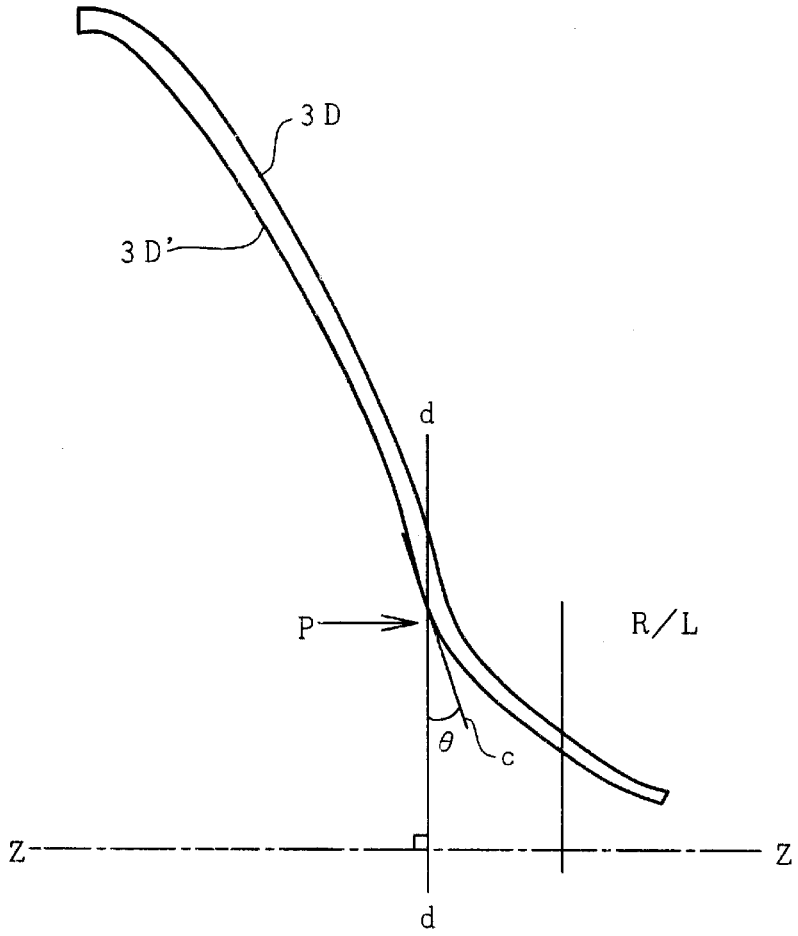
FIG. 3 is a cross-sectional view illustrating the inflection edge in a panel diagonal axis direction of the funnel portion of the color cathode ray tube of the embodiment.

FIG. 2(*a*) and FIG. 2(*b*) are enlarged cross-sectional views showing the inflection edge of the funnel portion along the long axis and the short axis shown in FIG. 1(*a*), and FIG. 3 is an enlarged cross-sectional view showing the inflection edge of the funnel portion along the diagonal axis similarly, wherein the neck portion shown in FIG. 1(*a*) is omitted. As shown in FIG. 2(*a*) to FIG. 3, the inflection edge P is disposed close to the panel portion in the deflection yoke mounting region AR.

In the color cathode ray tube of this embodiment, both the angle θ made by a straight line x-x, which passes through the endmost face of the inflection edge P present on the inner surface 3H' of the funnel portion in the long axis direction and is disposed perpendicular to the tube axis Z-Z, and a tangent line b at the endmost face of the inflection edge P in the long axis direction, and the angle θ made by the straight line y-y which passes through the endmost face of the inflection edge P present on the inner surface 3V' of the funnel portion in the short axis direction and is disposed perpendicular to the tube axis Z-Z, and the tangent line a at the endmost face of the inflection edge P in the short axis direction, are set within a range of 5–11°.

In the similar manner, according to the color cathode ray tube of this embodiment, as shown in FIG. 3, the angle θ made by a straight line d-d, which passes through the endmost face of the inflection edge P present on the inner surface 3D' of the funnel portion along the diagonal axis and which is disposed perpendicular to the tube axis Z-Z, and a tangent line c at the endmost face of the inflection edge P along the diagonal axis is also set within a range of 5–11°.

The angles θ at the inflection edges P along the short axis, the long axis and the diagonal axis are not necessarily the same and may be different within the range of 5°–11° depending on the cross-sectional shapes of the inner and outer walls of the deflection yoke mounting region and the funnel. Further, only the angle θ at the inflection edge P on any one axis or two axes arbitrarily selected from the short axis, the long axis and the diagonal axis need be set within 5°–11°.

Figure 4:
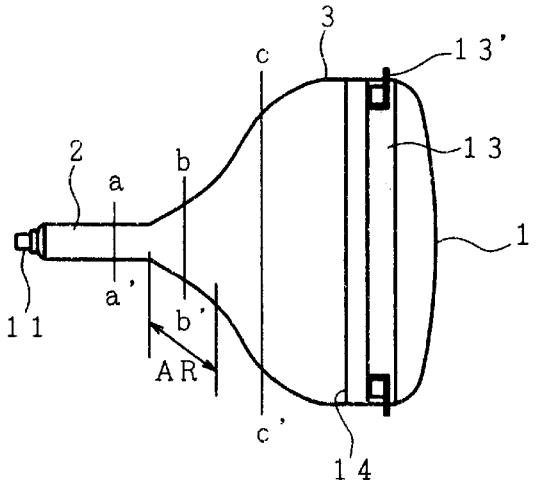
FIG. 4 is a side view showing the contour of the color cathode ray tube of the embodiment.

FIG. 4 is an explanatory view showing the contour of the color cathode ray tube of this embodiment. In this color cathode tube, the panel portion 1 and the funnel portion 3 are adhered to each other along a seal line 14. An explosion-proof band 13 is fastened in the vicinity of a panel portion side of this seal line 14. Numeral 13' indicates a mounting bracket. A stem 11 is mounted on the terminal end of the neck portion 2, and the deflection yoke mounting region AR which has a deflection yoke mounted thereon is formed at a transition portion of the funnel portion 3 connected with the neck portion 2. The deflection yoke (not shown in the drawing) is mounted on this deflection yoke mounting region AR. The manner of mounting the deflection yoke may involve a method which slidably fits the deflection yoke around the neck portion 2 from the stem 11 side or a method which uses a deflection yoke having a two-split structure and combines them around the deflection yoke mounting region AR.

Figure 5:
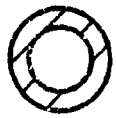
FIG. 5(*a*) is a cross-sectional view of FIG. 4 taken along a line a–a'.
Figure 5:
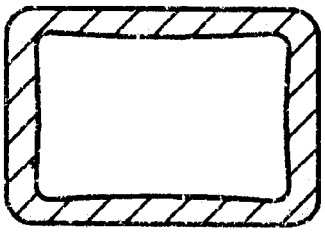
Figure 5:
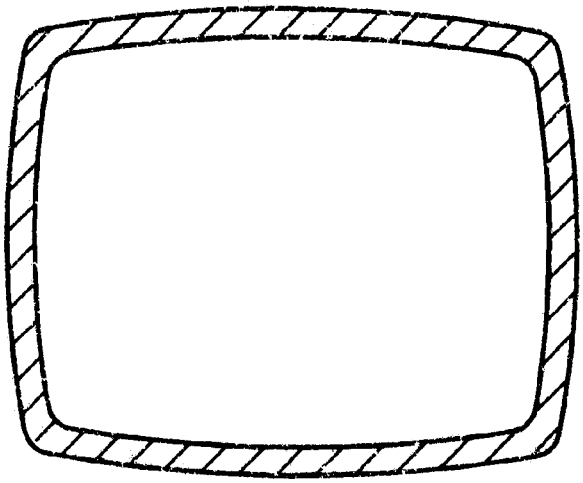

FIG. 5(*a*) to FIG. 5(*c*) are explanatory views showing the cross-sectional shapes of the essential portions of the color cathode ray tube shown in FIG. 4, wherein FIG. 5(*a*) shows a cross section taken along a line a–a' of FIG. 4, FIG. 5(*b*) shows a cross section taken along a line b–b' of FIG. 4, and FIG. 5(*c*) shows a cross section taken along a line b–b' of FIG. 4. In the color cathode ray tube of this embodiment, the cross-sectional shape of an electron gun accommodating portion of the neck portion 2 is circular, as shown in FIG. 5(*a*), and the cross-sectional shape of the deflection yoke mounting region AR portion of the funnel portion 3 is formed such that the profile line of the outer wall along a cross section perpendicular to the tube axis is approximately rectangular and the profile line of the inner wall along the cross section perpendicular to the tube axis approximately forms a pin-cushion shape, as shown in FIG. 5(*b*). The cross-sectional shape of the color cathode ray tube of this embodiment from the deflection yoke mounting region AR to the panel 1 side is approximately rectangular which is similar to the screen shape as shown in FIG. 5(*c*).

Figure 6:
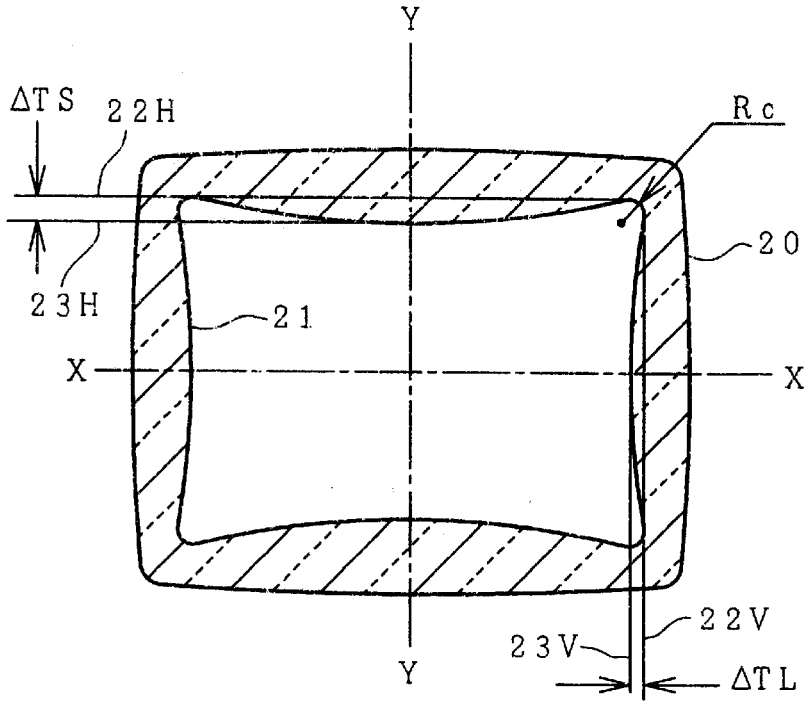
FIG. 6 is a cross-sectional view at a reference line of a deflection yoke mounting region shown in FIG. 4.

FIG. 6 shows one example of the cross-sectional shape along the reference line of the deflection yoke mounting region of the color cathode ray tube of this embodiment shown in FIG. 4. This reference line (R/L) is positioned at the central portion of the deflection yoke mounting region in the tube axis direction. In FIG. 6, numeral 20 indicates an outer wall of the deflection yoke mounting region (a profile line of the outer wall of the pyramidal portion on a cross section perpendicular to the tube axis) and numeral 21 indicates an inner wall (a profile line of the inner wall of the same pyramidal portion on the same cross section). As shown in FIG. 6, the cross sectional shapes of the outer wall and the inner wall are both approximately rectangular, wherein the outer wall shape is formed of a shape which has the central portions thereof slightly bulged toward the outside (the shape in which four sides constituting the profile are protruded outwardly), while the inner wall shape 21 is formed to have a so-called pin-cushion shape which has recesses having a radius of curvature Rc at respective corners (four corner portions) (a shape in which the four sides constituting the profile are protruded inwardly).

In the color cathode ray tube of this embodiment, the distance ΔTL between a straight line (vertical direction: first straight line) 22V which is disposed parallel to a short axis Y—Y, which connects neighboring bottom portions of the corner portions, and a straight line 23V, which is in contact with an intermediate point of the inner wall shape 21 and is disposed parallel to the short axis Y-Y, and the distance ΔTS between a straight line (horizontal direction: second straight line) 22H, which is disposed parallel to a long axis X-X and a straight line 23H which is in contact with an intermediate point of the inner wall shape 21 and is disposed parallel to the long axis X-X, are set to not more than 2.0 mm, and preferably not more than 1.0 mm in the region of the deflection yoke mounting region which extends 35 mm toward the panel portion side from the reference line and 20 mm toward the neck portion side, provided that the direction toward the tube axis is taken as +.

In the color cathode ray tube of this embodiment, the outer wall shape 20 in the deflection yoke mounting region is not limited to an approximately barrel shape (a protruded surface) which is slightly bulged outwardly both at the short axis side and the long axis side, and four sides which constitute the plane, that is, the profile of the cross section or one of a pair of two sides may be formed by a straight line.

Figure 7:
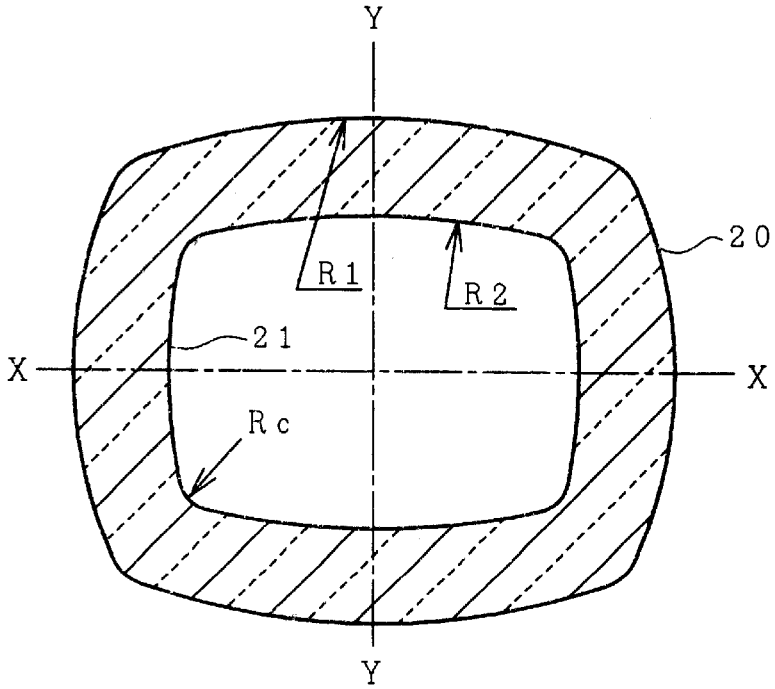
FIG. 7 is a cross-sectional view showing the cross section at a reference line of a deflection yoke mounting region shown in FIG. 4 in another embodiment.

As another embodiment, the inner wall shape 21 and the outer wall shape 20 in the deflection yoke mounting region may be respectively formed in a barrel shape, as shown in FIG. 7. FIG. 7 is a view illustrating the shape of the cross section along the reference line of the deflection yoke mounting region of the color cathode ray tube of another embodiment of the present invention. In the color cathode ray tube of this embodiment of the present invention, as shown in FIG. 7, the profile line of the outer wall 20 and the profile line of the inner wall 21 are both formed in a barrel shape. In this configuration, the radius of curvature of the profile line of the outer wall 20 is set to $R_1$ (mm) and the radius of curvature of the profile line of the inner wall 21 is set to $R_2$ (mm), and the relationship that $R_1 \geqq 100$ mm and $R_1 \leqq R_2$ $R_1 \geqq R_2$ is established. In the color cathode ray tube having the above-mentioned constitution, as in the case of the embodiment shown in FIG. 6, the sensitivity of the deflection magnetic field generated by the deflection yoke relative to the electron beams is enhanced and the deflection power can be reduced. It is sufficient so long as the above-mentioned relationship between the radius of curvature $R_1$ of the profile line of the outer wall 20 and the radius of the curvature $R_2$ of the profile line of the inner wall 21 is determined at least on the reference line of the deflection yoke mounting region.

Figure 8:
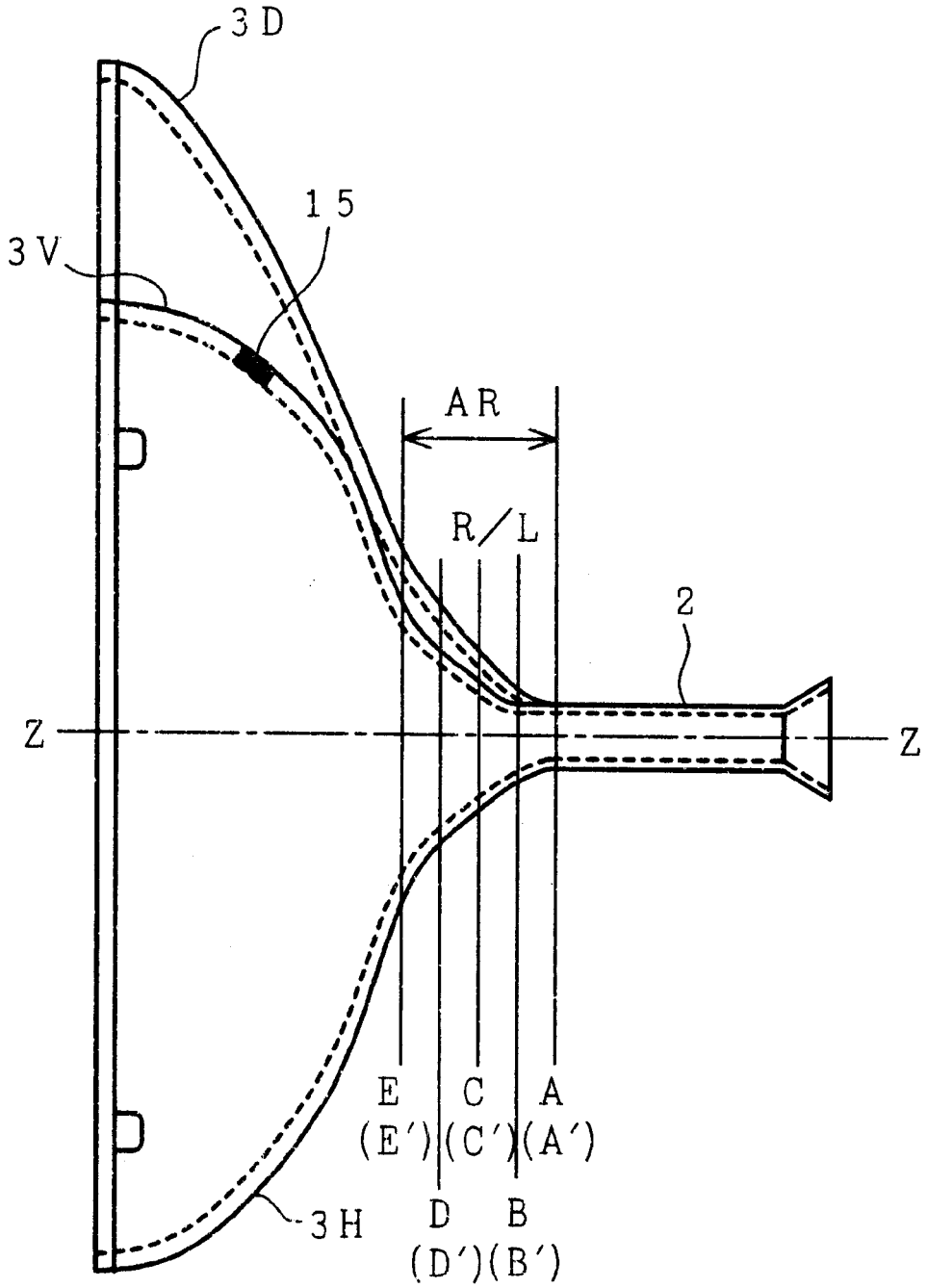
FIG. 8 is a cross-sectional view illustrating the contour of the funnel portion of the color cathode ray tube of the embodiment.
Figure 9:
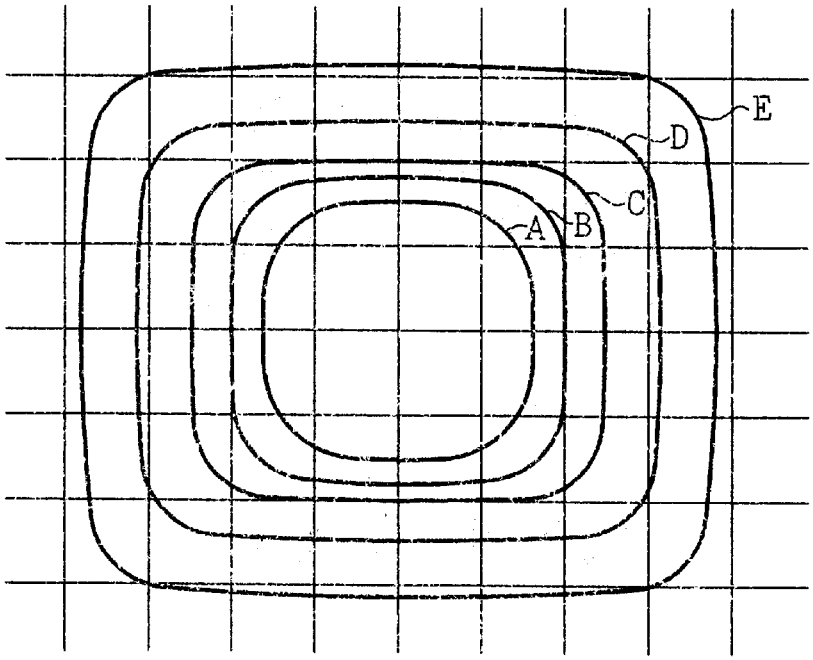
FIG. 9(*a*) is a diagram of a cross-sectional shape of an outer wall at the deflection yoke mounting region shown in FIG. 8.
Figure 9:
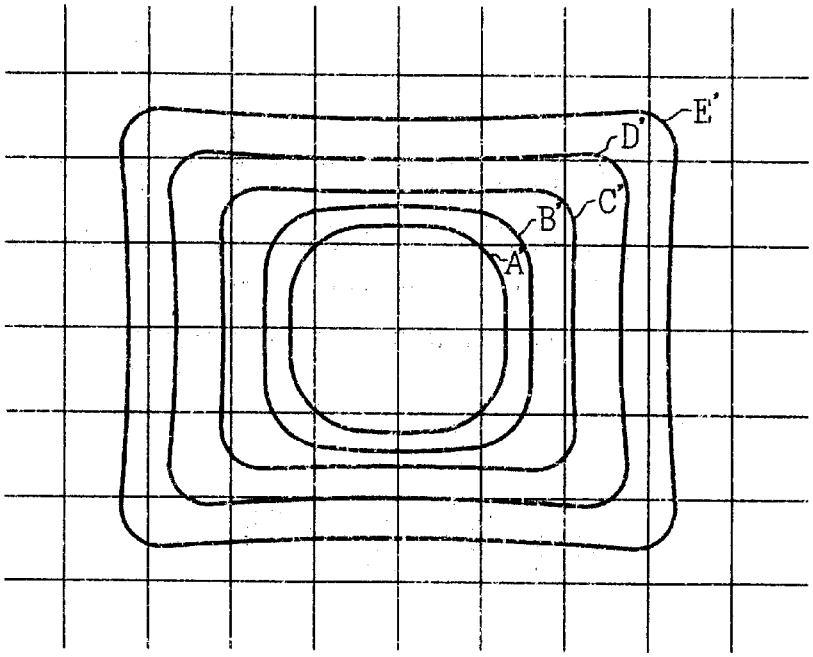
Figure 10A:
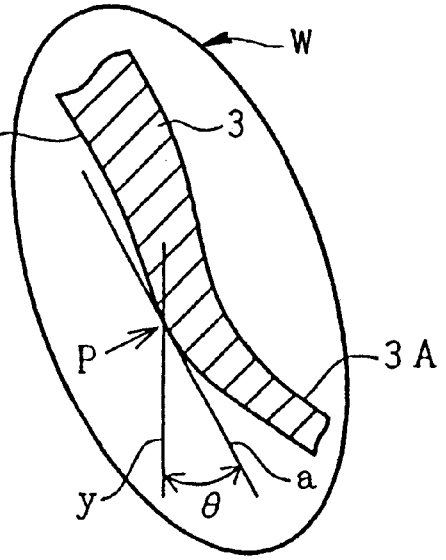
FIG. 10 is a partial cross-sectional view of a conventional cathode ray tube with a panel portion and a funnel portion thereof cut along a tube axis.
Figure 10:
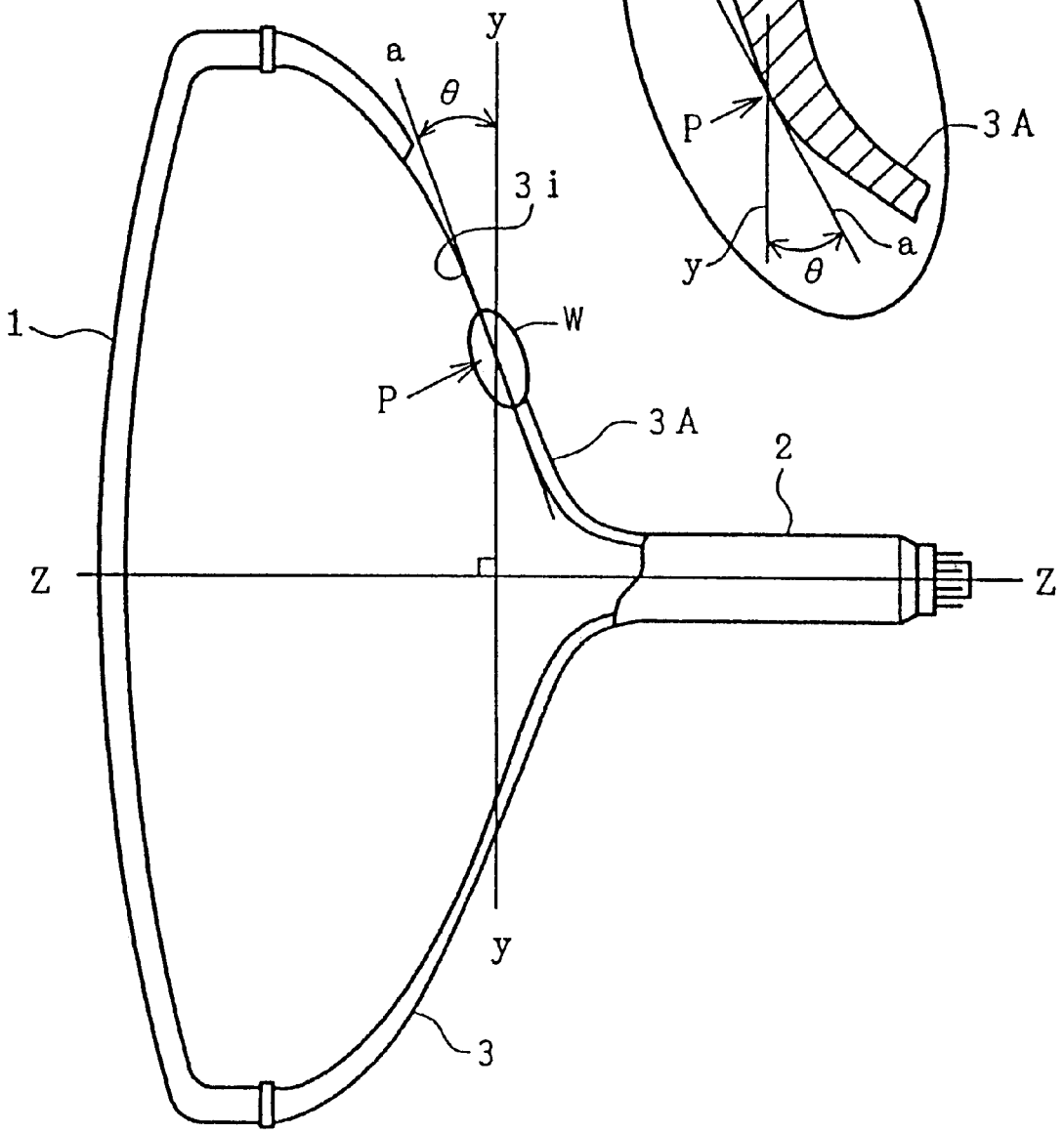

FIG. 8 is an explanatory view showing the contour of a funnel portion of a color cathode ray tube of this embodiment. FIG. 9(*a*) is a diagram showing the outer wall shape at the deflection yoke mounting region shown in FIG. 8, while FIG. 9(*b*) is a diagram showing the inner wall shape at the deflection yoke mounting region shown in FIG. 8. In FIG. 9(*a*) and FIG. 9(*b*), longitudinal and lateral straight lines are reference lines for more clearly showing the bulge of the cross-sectional shapes.

In FIG. 8, numeral 2 indicates a neck portion, numeral 3V indicates a funnel outer wall in a short axis direction, numeral 3H indicates a funnel outer wall in a long axis direction, numeral 3D indicates a funnel outer wall in a diagonal direction, and numeral 15 indicates an anode button. Further, Z-Z indicates a tube axis, AR indicates a deflection yoke mounting region, a R/L indicates a reference line, A(A'), B(B'), C(C'), D(D'), E(E') indicate section lines at a plurality of positions along the tube axis in the deflection yoke mounting region, wherein A, B, C, D, E show the positions of section lines of the outer wall and A', B', C', D', E' show the positions of section lines of the inner wall. The section line C(C') agrees with the reference line R/L.

A, B, C, D, E of FIG. 9(*a*) correspond to views showing the outer wall shapes (views showing the profile line shapes) cut along the section lines A, B, C, D, E of FIG. 8, while A', B', C', D', E' of FIG. 9(*b*) correspond to views showing the inner wall shapes (views showing the profile line shapes) cut along the section lines A', B', C', D', E' of FIG. 8. As shown in FIG. 9(*a*), the outer wall in the deflection yoke mounting region of the color cathode ray tube of the embodiment has a shape which protrudes outwardly from the tube axis substantially over the entire region. Further, in this embodiment, as shown in FIG. 9(*b*), the inner wall has a shape which protrudes toward the tube axis (that is, formed in a pin-cushion shape) when the section line exceeds the section line C', that is, the reference line and extends in a panel portion direction. The inner wall shape, however, is not limited to this inner wall shape, and the inner wall shape may be a shape which protrudes toward the tube axis side (that is, a pin-cushion shape) even when the section line extends in a neck portion direction from the reference line (section line C').

Due to the constitutions of the embodiments which have been explained heretofore, the power consumption of the deflection yoke can be minimized, a reliable internal graphite film coating operation is made possible, the internal graphite before drying does not concentrate in the vicinity of the inflection point and flows into the entire inner surface of the funnel portion, thus avoiding the peeling off of the graphite film caused by the unevenness of the film thickness and the sagging of the graphite which is not dried from the deflection yoke mounting region to the inner wall of the neck portion.

Further, so long as a cathode ray tube has an inflection edge in which the inner surface angle thereof changes from the inner wall of the deflection yoke mounting region to the panel portion side inner wall of the funnel portion, the present invention is not limited to a cathode ray tube having a funnel portion with a cross-sectional shape of the above-mentioned embodiments and is applicable to cathode ray tubes having deflection yoke mounting regions with shapes other than pyramidal shapes.

Although the present invention is effective for a color cathode ray tube with a deflection angle of 90°, it is more effective when it is applied to a color cathode ray tube with a large deflection angle of, for example, 100° or 110°. This is because, as the deflection angle becomes larger, the problem concerning the increase of the deflection power becomes more important.

The present invention is effective for a color cathode ray tube having a neck portion whose outer diameter is 22.5 mm–29.1 mm. In case the present invention is applied to a cathode ray tube having a neck portion whose outer diameter is not more than 25.3 mm, a further reduction of the deflection power can be realized. Further, it is preferable that the outer diameter of the neck portion is set to not more than 25.3 mm and the distance between electron beams (electron beam distance: S) is set to not more than 5.0 mm, preferably not more than 4.75 mm, at the main lens of the electron gun. Such a constitution can minimize the danger that the electron beams impinge on the inner wall of the funnel portion, in addition to providing a reduction of the deflection power.

The present invention is not limited to the color cathode ray tubes of the above-mentioned type or having the above-mentioned specification. The present invention is applicable to a so-called flat tube in which the outer surface of a panel portion is a flat surface, in the same manner as the color cathode ray tube whose outer surface of the panel portion is a curved surface.

What is claimed is:

1. A color cathode ray tube including a vacuum envelope comprised of:

a panel portion having an approximately rectangular shape, which has a long axis, a short axis, and a diagonal axis, with a phosphor film formed on an inner surface thereof;

a neck portion having a circular cross section which accommodates an electron gun; and a funnel portion which is gradually enlarged toward a panel portion side thereof and gradually reduced in the opening cross section thereof toward a neck portion side and includes a deflection yoke mounting region having a pyramidal shape at a side which is connected to the neck portion;

wherein an inflection point, at which a curving direction of an inner wall changes from an inner wall of the deflection yoke mounting region to a panel portion side inner wall, is formed on an inner surface of the funnel portion at a cross section of the color cathode ray tube including a tube axis and at least one of the long axis, the short axis, and the diagonal axis; and wherein an angle made by a straight line, which passes through the inflection point and is perpendicular to the tube axis, and a tangent line at the inflection point which passes through the tube axis is within 5°–11°.

2. A color cathode ray tube according to claim 1, wherein an inner wall opening shape of the deflection yoke mounting region of the funnel portion, perpendicular to the tube axis direction, has recesses having a curvature at respective corners; and wherein the distance between a first straight line which connects bottom portions of neighboring recesses of the corner portions and a second straight line which is in contact with a central point of an inner wall between the neighboring corners and is parallel with the first straight line is not more than 2.0 mm, provided that the direction toward the tube axis is taken as +.

3. A color cathode ray tube according to claim 1, wherein at a reference line set in the deflection yoke mounting region of the funnel portion, the outer wall opening and the inner wall opening perpendicular to the tube axis are respectively formed in an approximately rectangular shape and an approximately barrel shape; and wherein with the radius of curvature of the cross section of an outer wall set as $R_1$ (mm) and the radius of curvature of the cross section of the inner wall in a direction corresponding to the radius of curvature $R_1$ set as $R_2$ (mm), $R_1 \geqq 100$ mm and $R_2 \geqq R_1$.

4. A color cathode ray tube according to claim 1, wherein the outer diameter of the neck portion accommodating the electron gun is not more than 25.3 mm.

5. A color cathode ray tube according to claim 2, wherein the outer diameter of the neck portion accommodating the electron gun is not more than 25.3 mm.

6. A color cathode ray tube according to claim 3, wherein the outer diameter of the neck portion accommodating the electron gun is not more than 25.3 mm.

7. A color cathode ray tube according to claim 1, wherein a deflection angle of the color cathode ray tube is not less than 90°.

8. A color cathode ray tube according to claim 1, wherein a deflection angle of the color cathode ray tube is not less than 100°.

9. A color cathode ray tube according to claim 2, wherein a deflection angle of the color cathode ray tube is not less than 90°.

10. A color cathode ray tube according to claim 2, wherein a deflection angle of the color cathode ray tube is not less than 100°.

11. A color cathode ray tube according to claim 3, wherein a deflection angle of the color cathode ray tube is not less than 90°.

12. A color cathode ray tube according to claim 3, wherein a deflection angle of the color cathode ray tube is not less than 100°.

13. A color cathode ray tube including a vacuum envelope comprised of:

a panel portion having an approximately rectangular shape, which has a long axis, a short axis, and a diagonal axis, which has a planar surface on an outer surface thereof and a phosphor film formed on an inner surface thereof;

a neck portion having a circular cross section which accommodates an inline type electron gun; and a funnel portion which is gradually enlarged toward a panel portion side thereof and gradually reduced in the opening cross section thereof toward a neck portion side and includes a deflection yoke mounting region having a pyramidal shape at a side which is connected to the neck portion;

wherein an inflection point, at which a curving direction of an inner wall changes from an inner wall of the deflection yoke mounting region to a panel portion side inner wall, is formed on an inner surface of the funnel portion at a cross section of the color cathode ray tube including a tube axis and at least one of the long axis, the short axis, and the diagonal axis;

wherein an angle made by a straight line, which passes through the inflection point and is perpendicular to the tube axis, and a tangent line at the inflection point which passes through the tube axis is within 5°–11°;

wherein the inner wall opening shape of the deflection yoke mounting region of the funnel portion, perpendicular to the tube axis direction, has recesses having a curvature at respective corners; and wherein the distance between a first straight line which connects bottom portions of neighboring recesses of the corner portions and a second straight line which is in contact with a central point of an inner wall between the neighboring corners and is parallel with the first straight line is not more than 1.0 mm, provided that the tube axis direction is taken as +.

14. A color cathode ray tube according to claim 13, wherein the outer diameter of the neck portion accommodating the inline type electron gun is not more than 25.3 mm.

15. A color cathode ray tube according to claim 14, wherein the distance among electron beams at a main lens portion of the inline type electron gun is not more than 5.0 mm.

16. A color cathode ray tube according to claim 14, wherein the distance among electron beams at a main lens portion of the inline type electron gun is not more than 4.75 mm.

17. A color cathode ray tube according to claim 13, wherein a deflection angle of the color cathode ray tube is not less than 90°.

18. A color cathode ray tube according to claim 13, wherein a deflection angle of the color cathode ray tube is not less than 100°.

19. A color cathode ray tube according to claim 1, wherein the funnel portion is configured so that an internal graphite film coating on the inner surface of the funnel portion has at least one of (1) an even film thickness in a vicinity of the inflection point, and (2) no sagging portion extending from the funnel portion toward the neck portion, as a result of avoiding concentration of a graphite coating liquid in the vicinity of the inflection point during formation of the internal graphite film coating.

20. A color cathode ray tube according to claim 13, wherein the funnel portion is configured so that an internal graphite film coating on the inner surface of the funnel portion has at least one of (1) an even film thickness in a vicinity of the inflection point, and (2) no sagging portion extending from the funnel portion toward the neck portion, as a result of avoiding concentration of a graphite coating liquid in the vicinity of the inflection point during formation of the internal graphite film coating.

* * * * *